US005898941A

United States Patent [19]

Groshens

[11] Patent Number: 5,898,941

[45] Date of Patent: May 4, 1999

[54] COLLAR WITH A REINFORCING BASE FABRIC

[75] Inventor: Pierrot Groshens, Peronne, France

[73] Assignee: Lainiere de Picardie, Peronne, France

[21] Appl. No.: 08/848,054

[22] Filed: Apr. 29, 1997

[30] Foreign Application Priority Data

Apr. 30, 1996 [FR] France ..... 96 05458

[51] Int. Cl.[6] ..... A41B 3/00

[52] U.S. Cl. ..... 2/129; 2/272

[58] Field of Search ..... 2/129, 122, 27, 2/243.1, 272

[56] References Cited

U.S. PATENT DOCUMENTS 2,201,808 5/1940 McBurney e tal. ..... 2/129

2,233,477 3/1941 Hilberg ..... 2/129

*Primary Examiner*—Gloria M. Hale

*Attorney, Agent, or Firm*—Kilpatrick Stockton LLP

[57] ABSTRACT

The present invention concerns a reinforcing base fabric (1) for fabrics, cloths, clothing, consisting of a weft knit fabric (2) comprising an insertion of reinforcing and stabilizing yarns (3) extending in the direction of the weft between the rows, the reinforcing and stabilizing yarns being flat and free from crimp stress.

15 Claims, 2 Drawing Sheets

4
9
3
8
D

IV
IV
9
10
3
8
D

COLLAR WITH A REINFORCING BASE FABRIC

FIELD OF THE INVENTION

The invention relates to a reinforcing base fabric for fabrics, cloths, clothing, and more particularly to the application of such a reinforcing base fabric to a shirt collar, and a method for achieving such a collar.

BACKGROUND

Shirt collars including an interlining are already known.

Refer to documents FR-A-2 570 577 and FR-A-2 609 873, for example.

Conventionally, interlinings or reinforcing pieces for shirt collars are made either woven, of polyester for example, or nonwoven.

However, existing shirt collars have a disadvantage in that the dimensional stability of the collar cannot be perfectly ensured in time. Indeed, when the shirt, and therefore the collar, is washed repeatedly, the stabilisation provided by the reinforcing interlining of the collar deteriorates, leading to a modification of the neck measurement, which is particularly inconvenient. This loss of neck measurement can attain 1.5 or even 2.5 cm, if not more.

Reinforcing pieces for the localised stiffening of textiles (see FR-A-2 531 616), thermofusible interlinings (see FR-A-2 462 456) and, finally, thermofusible linings in the form of weft knit fabrics (see FR-A-2 710 078) are also known in the art.

A shirt collar including two strips of fabric with different stretching abilities on the inside is already known from document FR-A-680 742.

The problem at the root of the invention consists in ensuring the dimensional stability of a shirt collar taking into account the regular upkeep of this article of clothing, including repeated washing and ironing.

SUMMARY OF THE INVENTION

For this purpose, the invention implements a reinforcing base fabric consisting of a weft knit fabric comprising an insertion of reinforcing and stabilising yarns extending in the direction of the weft between the rows of stiches.

According to other characteristics, the reinforcing and stabilising yarns are flat and free from crimp stress. These reinforcing and stabilising yarns are heat stabilised.

Such a reinforcing base fabric may also include an inserted nonwoven lap.

The reinforcing base fabric may also comprise an adhesive or thermofusible material intended to ensure its subsequent association with the fabric.

The reinforcing and stabilising yarns consist of synthetic fibres or filaments. Their density and yarn numbering are determined according to the weight and/or stiffness and volume (thickness) desired.

According to another aspect, the invention relates to the application of such a reinforcing base fabric to a shirt collar, its dimensional stability being particularly and mainly improved in the large direction, i.e. the neck measurement.

According to another aspect, the invention concerns a shirt collar which includes a reinforcing base fabric such as described above associated with it.

The reinforcing base fabric may act as an interlining itself, or it may reinforce an interlining associated with the collar piece(s).

This reinforcing base fabric includes a coat of adhesive or thermofusible material so as to ensure its association with the collar piece(s) or the interlining.

Such an interlining is made of cotton or equivalent.

The reinforcing and stabilising yarns of the reinforcing base fabric are arranged in the large direction of the collar, i.e. the neck measurement. In this case, the weft of the reinforcing base fabric extends in the direction of the neck measurement.

A collar such as described above may include two pieces of fabric, top and bottom, respectively, assembled together and between which the reinforcing base fabric is inserted.

According to a last aspect of the invention, a method for achieving a collar such as described above is proposed which includes a step consisting in associating a reinforcing base fabric such as previously described with the piece(s) of fabric of the collar. According to the alternate embodiments considered, the reinforcing base fabric is associated with the piece(s) of fabric of the collar or with an interlining, only.

The other characteristics and advantages of the invention will be best understood upon reading the description which follows, made with reference to the attached drawings.

DETAILED DESCRIPTION

Figure 1:
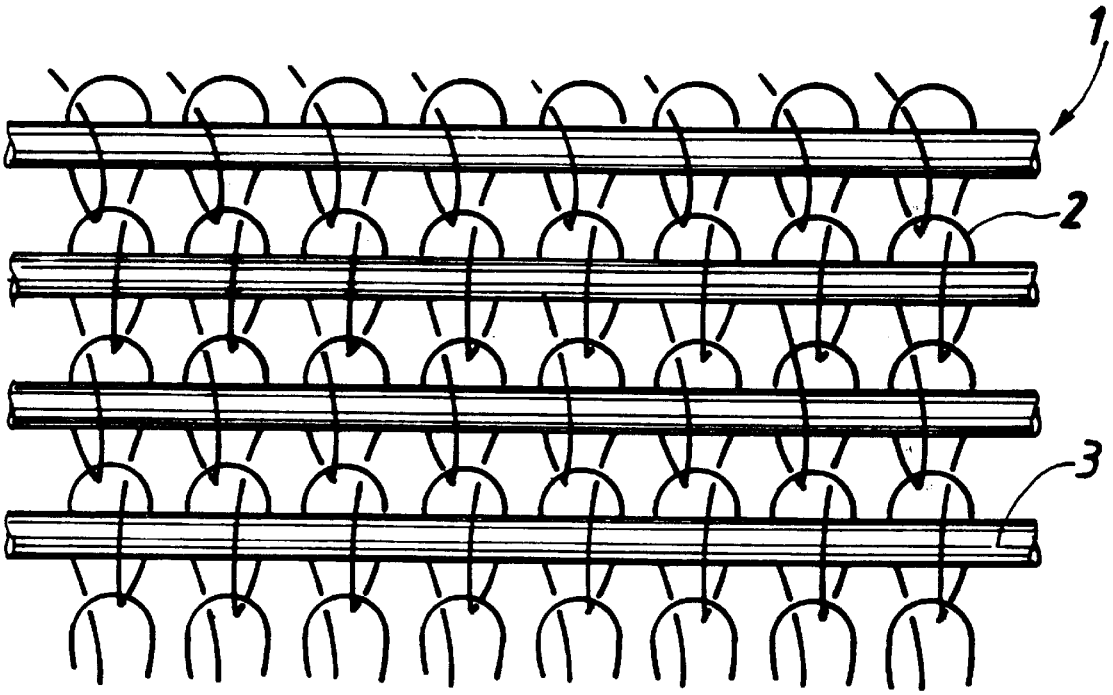
FIG. 1 is a schematic front view of a reinforcing base fabric according to the invention.

As shown in FIG. 1, the reinforcing base fabric 1 according to the invention consists of a weft knit fabric 2 comprising reinforcing and stabilising yarns 3 extending in the direction of the weft between the rows of stiches of the knitted fabric 2.

Weft knit fabrics are known in themselves and will therefore not be described in greater detail herein.

The reinforcing and stabilising yarns 3 are arranged in each space between two adjacent rows of stiches.

The reinforcing and stabilising yarns 3 are arranged in a regular manner.

In order to fulfil their reinforcing and, especially, stabilising function, the yarns 3 are arranged in a flat and even perfectly flat manner and are free from crimp stress.

This characteristic is obtained due to the fact that the yarns 3 do not participate in the actual stitches and are not conformed by the crossing of the warp and weft yarns of the knitted fabric 2.

In order to enhance the stabilising properties, the yarns 3 themselves are heat stabilised. This property is preferably obtained without adding a synthetic or chemical stabilising resin.

The yarns 3 consist of synthetic fibres or filaments, for example.

Their density and yarn numbering are determined according to the weight and/or stiffness and volume (thickness) desired.

Figure 2:
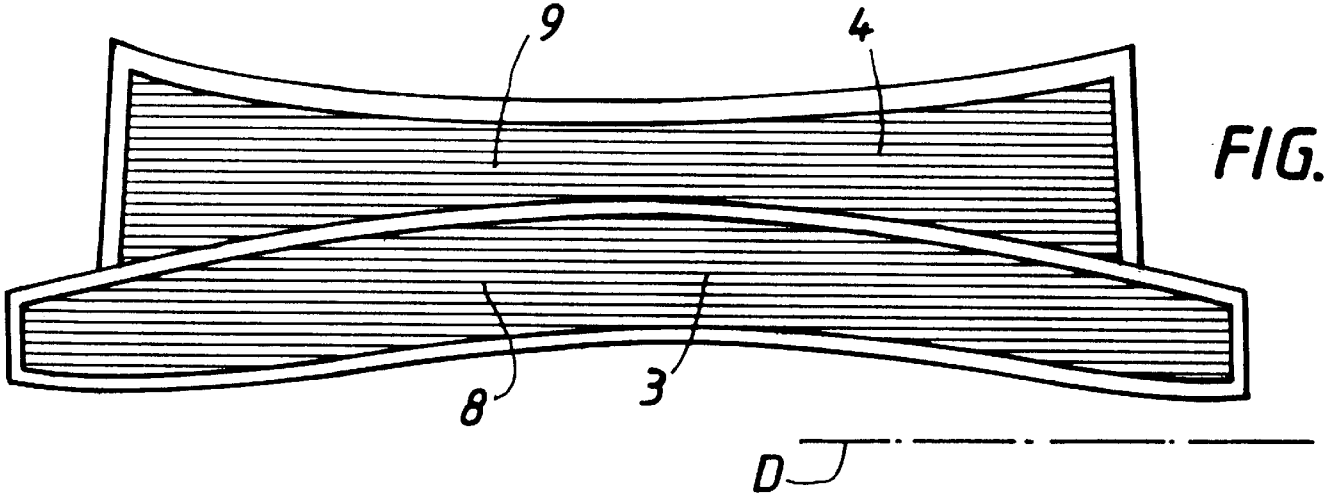
FIGS. 2 and 3 are two schematic front views, in horizontal position, of a collar of shirt, shirtwaist, or an equivalent piece including a reinforcing base fabric according to the invention.

The dimensional stability of the yarns 3 lengthwise results in the stability of the base fabric 1 in the direction of the weft. This dimensional stability makes it possible to enhance the dimensional stability of a shirt collar 4, as shown in FIG 2.

Figure 4:
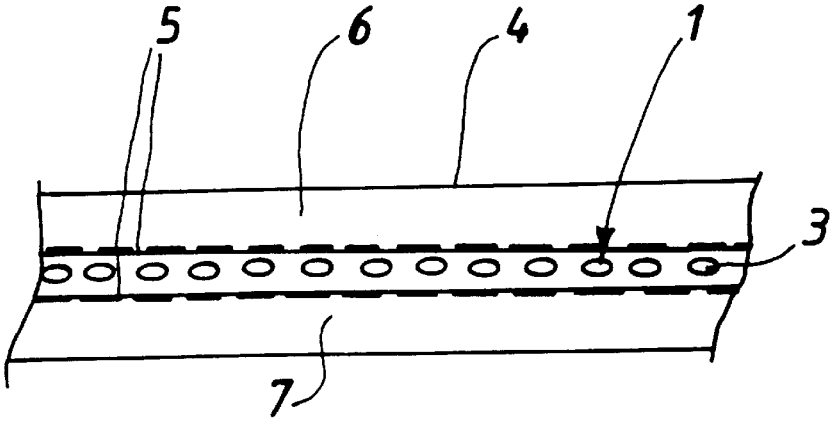
FIG. 4 is a partial sectional along line IV—IV of FIG. 2.

According to another possible embodiment, as shown in FIG. 4, the base fabric 1 includes an adhesive or thermofusible material 5 intended to ensure the subsequent association of the base fabric 1 with the fabric or piece 4, or possibly with an additional base fabric such as an interlining.

According to the implementations considered, the adhesive or thermofusible material 5 is arranged on one face of the base fabric 1 only, or on both of its faces. The adhesive or thermofusible material 5 is arranged in a continuous layer or in points.

Methods making it possible to arrange an adhesive or thermofusible material on a textile substrate are known in themselves and will therefore not be described hereinafter.

According to another possible embodiment, the base fabric 1 also includes an inserted nonwoven lap. Such a nonwoven lap makes it possible to give the fabric or piece 4 a certain volume.

A base fabric 1 such as described above is particularly intended for a shirt collar 4 so as to improve the dimensional stability of this article of clothing in time following repeated washing, ironing.

Figure 3:
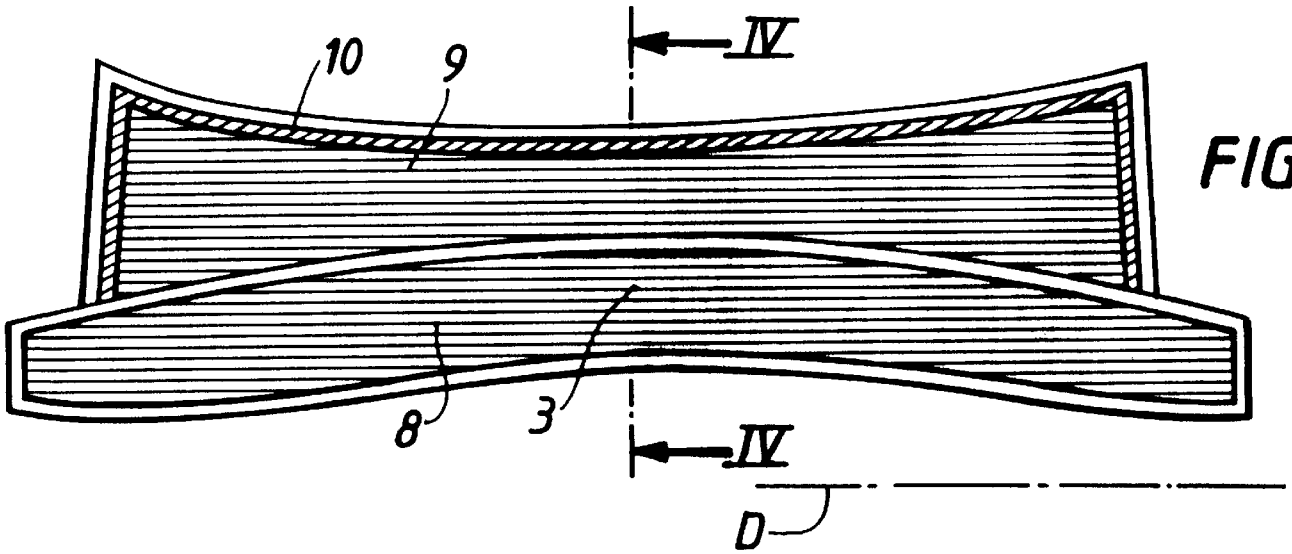

The piece 4 considered is a shirt collar or any similar piece. The dimensional stability searched for corresponds in particular to that of the large direction of this piece, indicated by reference D in FIGS. 2 and 3, i.e., in this case the neck measurement.

The search for such a dimensional stability or the improvement of such a dimensional stability is particularly necessary in the case of collars 4 which, due to their design or the raw materials used, would have a mediocre dimensional stability in the absence of a base fabric such as 1.

In the event where, due to its design or the raw materials used, the collar 4 already has an adequate dimensional stability, the latter will be enhanced even further.

In the embodiment shown in FIG. 4, the collar 4 includes two pieces, top 6 and bottom 7, respectively, associated with one another and between which the base fabric 1 is inserted.

The pieces 6, 7 are cut so as to comprise a part 8 referred to as the collar band, intended to be associated adjacent to the main part of the clothing, and a flap 9.

The two pieces 6, 7 are associated with one another either sewn to the periphery or thermofused.

To ensure its stabilising function, the base fabric 1 is arranged on the piece 4 with the yarns 3 arranged in the direction to be stabilised, in this case direction D, which corresponds to the neck measurement.

According to a possible embodiment, the base fabric 1 acts as an interlining (FIG. 2). In this case, the base fabric 1 includes the coat of adhesive or thermofusible material 5.

According to another possible embodiment (FIG. 3), the base fabric 1 is associated with an interlining 10, the latter being associated with the pieces 6, 7.

In this last case, the base fabric 1 is associated with the interlining 10 through heat welding or thermofusing.

Such an interlining 10 may be conventionally made of cotton or equivalent.

The method for achieving a collar such as described above includes a step consisting of associating a base fabric 1 with the pieces 6, 7.

According to the embodiments considered, the base fabric 1 is either associated with the pieces 6, 7 only or it is also associated with an interlining 10.

I claim:

1. A collar including:

at least one piece of fabric; and a reinforcing base fabric associated with the collar;

wherein the reinforcing base fabric includes a weft knit fabric comprising rows of stitches, the weft knit fabric further comprising an insertion of reinforcing and stabilizing yarns extending in the direction of a weft between the rows of stitches, the reinforcing and stabilizing yarns being rectilinear and free from crimp stress.

2. The collar of claim 1, wherein the reinforcing and stabilizing yarns are heat stabilized.

3. The collar of claim 1, wherein the reinforcing base fabric further includes an inserted nonwoven lap.

4. The collar of claim 1, wherein the reinforcing base fabric further includes an adhesive material intended to ensure subsequent association of the reinforcing base fabric with the at least one fabric.

5. The collar of claim 1, wherein the reinforcing base fabric further includes a thermofusible material intended to ensure subsequent association of the reinforcing base fabric with the at least one fabric.

6. The collar of claim 1, wherein the reinforcing base fabric further includes an adhesive material intended to ensure subsequent association of the reinforcing base fabric with an interlining.

7. The collar of claim 1, wherein the reinforcing base fabric further includes a thermofusible material intended to ensure subsequent association of the reinforcing base fabric with an interlining.

8. The collar of claim 1, wherein the reinforcing and stabilizing yarns are comprised of one from the group consisting of synthetic fibers and synthetic filaments.

9. The collar of claim 1, wherein the reinforcing base fabric acts as an interlining.

10. The collar of claim 1, wherein or the reinforcing base fabric reinforces an interlining associated with the at least one piece of fabric.

11. The collar of claim 10, wherein the interlining associated with the at least one piece of fabric comprises at least one material selected from the group consisting of cotton and a cotton equivalent.

12. The collar of claim 1, wherein the collar has a lengthwise axis, wherein the reinforcing and stabilizing yarns of the reinforcing base fabric have lengthwise axes, and wherein the axes of the reinforcing and stabilizing yarns of the reinforcing base fabric are oriented parallel to the lengthwise axis of the collar.

13. The collar of claim 1, wherein the collar includes a top piece of fabric and a bottom piece of fabric, the top and bottom pieces of fabric being assembled together, wherein the reinforcing base fabric is inserted between the top and bottom pieces of fabric.

14. A method for assembling a shirt collar, comprising:

inserting reinforcing and stabilizing yarns in the direction of a weft between the rows of stitches of a weft knit fabric, the weft knit fabric and reinforcing and stabilizing yarns forming a reinforcing base fabric, wherein the reinforcing and stabilizing yarns are rectilinear and free from crimp stress;

arranging the reinforcing base fabric with at least one piece of fabric for the shirt collar.

15. A method for assembling a shirt collar, comprising:

inserting reinforcing and stabilizing yarns in the direction of a weft between the rows of stitches of a weft knit fabric, the weft knit fabric and reinforcing and stabilizing yarns forming a reinforcing base fabric, wherein the reinforcing and stabilizing yarns are rectilinear and free from crimp stress;

arranging a reinforcing base fabric with an interlining associated with the at least one piece of fabric for the shirt collar.

* * * * *